US006300925B1

(12) United States Patent
Johnson et al.

(10) Patent No.: US 6,300,925 B1
(45) Date of Patent: Oct. 9, 2001

(54) DISPLAY DEVICE

(75) Inventors: Mark T. Johnson, Eindhoven (NL); Alan G. Knapp, Pound Hill Crawley Sussex (GB); Adrianus A. Van Der Put, Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/175,249

(22) Filed: Oct. 20, 1998

(30) Foreign Application Priority Data

Oct. 20, 1997 (EP) ..... 97203265

(51) Int. Cl.[7] ..... G09G 3/36

(52) U.S. Cl. ..... 345/87; 345/94; 345/96; 345/208

(58) Field of Search ..... 345/87, 90, 92–96

(56) References Cited

U.S. PATENT DOCUMENTS

| | | | | |
|---|---|---|---|---|
| 5,128,663 | * | 7/1992 | Furuhashi et al. | 345/94 |
| 5,426,447 | * | 6/1995 | Lee | 345/103 |
| 5,510,807 | * | 4/1996 | Lee et al. | 345/103 |
| 5,526,015 | * | 6/1996 | Tsuboyama et al. | 345/97 |
| 5,555,001 | * | 9/1996 | Lee et al. | 345/93 |
| 5,818,409 | * | 10/1998 | Furuhashi et al. | 345/94 |

FOREIGN PATENT DOCUMENTS

| | | | | |
|---|---|---|---|---|
| 0394903 A2 | * | 10/1990 | (EP) | G09G/3/36 |
| 0657864A1 | | 6/1995 | (EP) | G09G/3/36 |

* cited by examiner

*Primary Examiner*—Richard Hjerpe
*Assistant Examiner*—Kimnhung Nguyen

(57) ABSTRACT

In a display device based on a TFT-matrix with capacitive coupling, the flicker is prevented by providing the selection lines with an auxiliary signal within a short time period before or after selection.

8 Claims, 4 Drawing Sheets

$t_F$
$t_F$
$t_{sel}$
15'
$t_{sel}$
$V_s$
$t_{row}$
$t_{row}$
$V_{s1}$
row n
$V_{s2}$ $t_{sel}$
$t_{row}$
15'
$V_s$
$t_{row}$
$V_{s1}$
row n+1
$V_{s2}$ $V_d$ $V_{cell}$
$+V_{50}$
$-V_{50}$ T
$t_0$ $t_1$
$t_2$ $t_3$
t T
$t_0$ $t_1$
$t_2$ $t_3$
$t_F$
$t_F$ $t_F$
$t_F$
$t_{row}$
$t_{row}$
$V_s$
$V_{g1}, V_{p1}$
$V_{p2}$
$V_{g2}$
15
15
row n $V_s$
$V_{g1}, V_{p1}$
$V_{p2}$
$V_{g2}$
15
row n+1

$V_d$
$V_d$
$-V_d$ $V_{cell}$
$+V_{50}$
0
$-V_{50}$ $T_{cell}$
50%
$t_0$ $t_1$ $t_2$ $t_3$ T
50%
$t_0$ $t_F$ $t_2$ $t_F$

DISPLAY DEVICE

The invention relates to a display device comprising an electro-optical material sandwiched between two substrates, at least one substrate being transparent, while a first substrate is provided with a matrix of picture electrodes, each picture electrode being coupled, via a switching element, to a row electrode and a column electrode, and the picture electrode being capacitively coupled to a further electrode, first drive means for providing the row electrodes, during a selection period, with a selection signal, and the row electrode or the further electrode with a bias signal, second drive means for providing the column electrodes with a data signal which, during successive selections, changes sign relative to a reference voltage.

In this application, the expression "capacitively coupled" is to be taken to mean that there is a coupling via an (auxiliary) capacitance, for example, in that a picture electrode associated with a row and a part of the row electrode associated with a subsequent (or preceding) row demonstrate a partial) overlap.

Such display devices are used, for example, in television and monitor applications.

A display device of the type mentioned in the opening paragraph is described in EP-A-0.657.864. In said document, a description is given of the way in which a DC-component across the liquid-crystal material is precluded in a liquid-crystal display device by adapting a selection signal. To achieve this, the selection signal consisting of a gate pulse is extended by so-called gate-bias voltages. In this application, the term selection signal is to be taken to mean the signal which causes the switching element to conduct (in general, the actual gate pulse of a TFT transistor). In this application, the terms bias signal or bias voltage, "(gate)-bias signal" or "(gate)-bias voltage", are to be taken to mean a bias signal or bias voltage as described in EP-A-0.657.864, and therefore not, when the gate-bias signal is presented to a selection electrode, the voltage on a row electrode during non-selection. Instead of being presented to a row electrode, the bias signal may also be presented, for example, to a common connection for a number of capacitances within one row. In this application, the term selection period is to be taken to mean the period which, for one selection, comprises the selection signal and the bias signal.

True, the capacitive coupling between a picture electrode and an adjoining row electrode leads to a substantial increase in speed of the display device, but still flicker has been found to occur frequently.

It is an object of the invention to provide, inter alia, a display device of the above-mentioned type in which the above drawbacks are at least partly overcome.

To achieve this, a display device in accordance with the invention is characterized in that the drive means comprise means for presenting an auxiliary signal to the row electrodes outside the selection periods for at least one of two successive selections of the same pixel.

The invention is based on the recognition that, for data signals of practically the same amplitude (for example the amplitude associated with median grey), the above-mentioned capacitive coupling gives rise, during successive selections of a pixel, to a difference in amplitude of the signal across the pixel and hence of the transmission. Besides, it has been found that the behavior of the pixel is subject to substantial variation. In particular, the difference in transmission of the signal across the pixel during successive selections gives rise to flicker. Via the above-mentioned capacitive coupling, the auxiliary signal influences the amplitude of the pixels in a subsequent or preceding row in such a manner that this difference in amplitude is compensated substantially completely.

The second substrate generally is provided with one or more counter-electrodes but this is not strictly necessary, as in the case of e.g. IPS (In Plane Switching).

A first embodiment of a display device in accordance with the invention is characterized in that the drive means comprise means for presenting auxiliary signals to the row electrodes outside the selection periods for two successive selections of the same pixel, which auxiliary signals change sign relative to a second reference voltage. In general, the second reference voltage is the voltage on the row electrodes during non-selection. The auxiliary signals generate, also outside the actual selection (bias) period, a correction signal across the pixel via the same capacitive coupling. The amplitude selected for the auxiliary signal can be such that, if said signal is presented via the row electrode, it does not select switches of the relevant row. As, in addition, it is presented outside the period associated with the bias signal, the above-mentioned DC-component remains negligible.

A second embodiment of a display device in accordance with the invention is characterized in that during two successive selections of the same pixel, the selection signals have different amplitudes. By virtue thereof, a difference in response of the display cell for data signals of opposite sign is obviated.

These and other aspects of the invention will be apparent from and elucidated with reference to the embodiments described hereinafter.

In the drawings.

The Figures are schematic and not drawn to scale; like reference numerals, generally refer to like parts.

Figure 1:
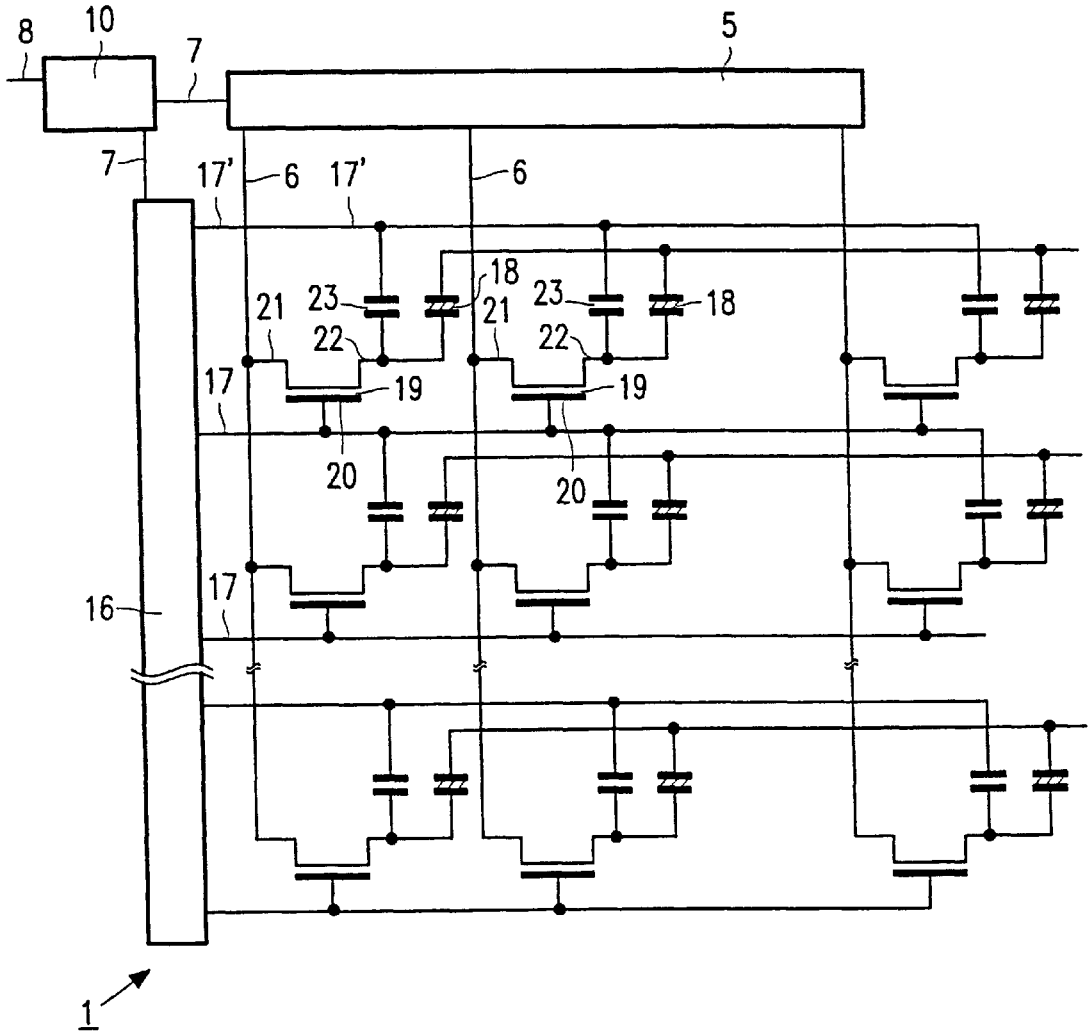
FIG. 1 shows an electrical circuit diagram of a part of the display device.

FIG. 1 shows an electrical equivalent of a part of a display device 1 to which the invention is applicable. It comprises a matrix of pixels 18 at the location of crossings of row or selection electrodes 17 and column or data electrodes 6. The row electrodes are successively selected by means of a row driver 16, while the column electrodes are provided with data via a data register 5. For this purpose, if necessary, incoming data 8 is first processed in a processor 10. Mutual synchronization of the row driver 16 and the data register 5 takes place via drive lines 7.

Drive signals originating from the row driver 16 select the picture electrodes via thin-film transistors (TFTs) 19 of which the gate electrodes 20 are electrically connected to the row electrodes 17 and the source electrodes 21 are electrically connected to the column electrodes. The signal present on the column electrode 6 is transferred via the TFT to a picture electrode of a pixel 18 which is coupled to the drain electrode 22. The other picture electrodes are connected, for example, to one (or more) common counter electrode(s).

The display device shown in FIG. 1 also comprises an auxiliary capacitor 23 at the location of each pixel. In this example, the auxiliary capacitor is connected between the common point of the drain electrode 22 and the display element in a specific row of pixels, on the one hand, and the row electrode of the preceding row of pixels, on the other hand; other configurations are also possible, for example between said common point and one of the subsequent rows of pixels (or a preceding row).

To preclude picture errors, the display device comprises an additional row electrode 17'.

Figure 2:
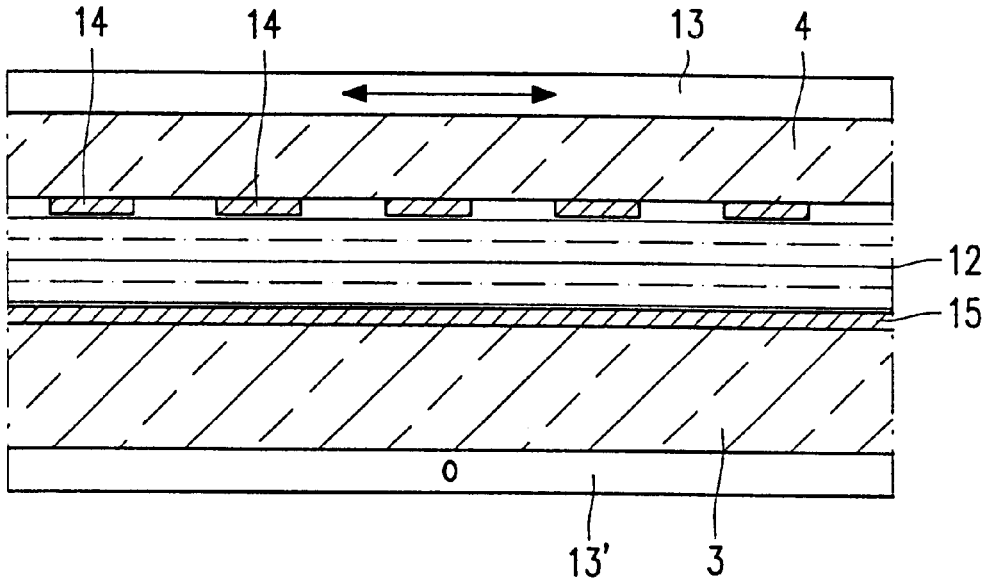
FIG. 2 is a schematic, sectional view of a part of the display device.
Figure 3:
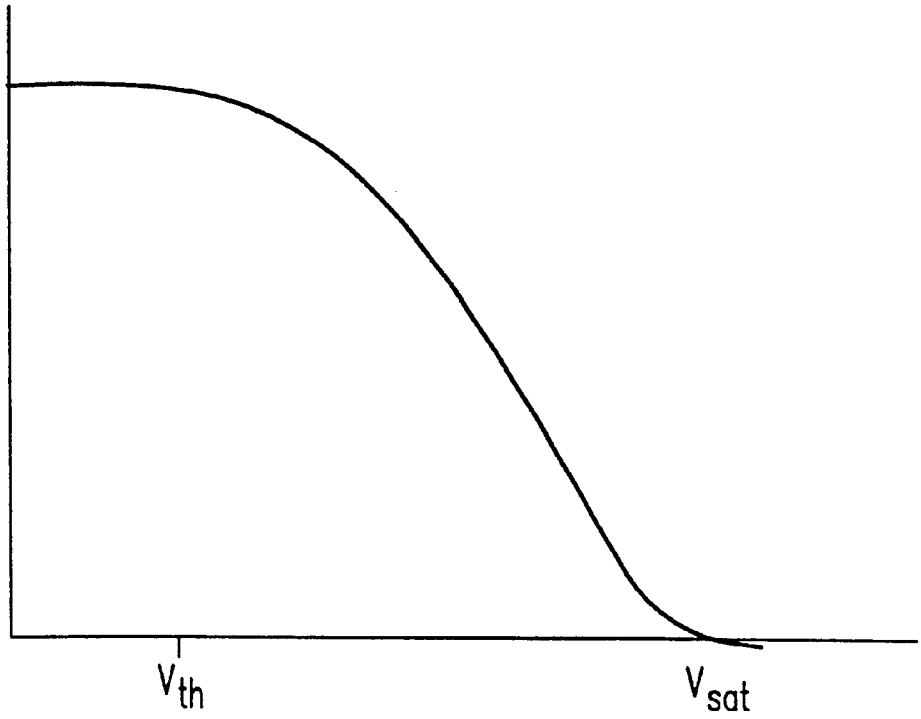
FIG. 3 shows the associated voltage-transmission curve.

FIG. 2 is a schematic cross-sectional view of a part of the liquid-crystal display device comprising a twisted nematic liquid-crystal material 12 which is sandwiched between two substrates 3, 4, which are made, for example, of glass. One of the substrates is provided with row and column electrodes which drive picture electrodes 14 via TFTs. The other substrate is furnished with a counter electrode 15. The device further comprises two polarizers 12, 13' having mutually perpendicular directions of polarization. The device further includes orientation layers (not shown) which orient the liquid-crystal material on the inner walls of the substrates, in this example in the direction of the axes of polarization of the polarizers, so that the cell has a twist angle of 90 degrees. In this case, the liquid-crystal material has a positive optical anisotropy and a positive dielectric anisotropy. Consequently, if an electric voltage is applied to the electrodes, the molecules and hence the directors orient themselves towards the field. FIG. 3 shows the associated transmission-voltage characteristic. The transmission starts to decrease at a threshold voltage $V_{th}$ and said decrease continues until the minimum transmission is reached at a saturation voltage $V_{sat}$.

Figures 4A, 4B, 4C, 4D, 4E, 4F:
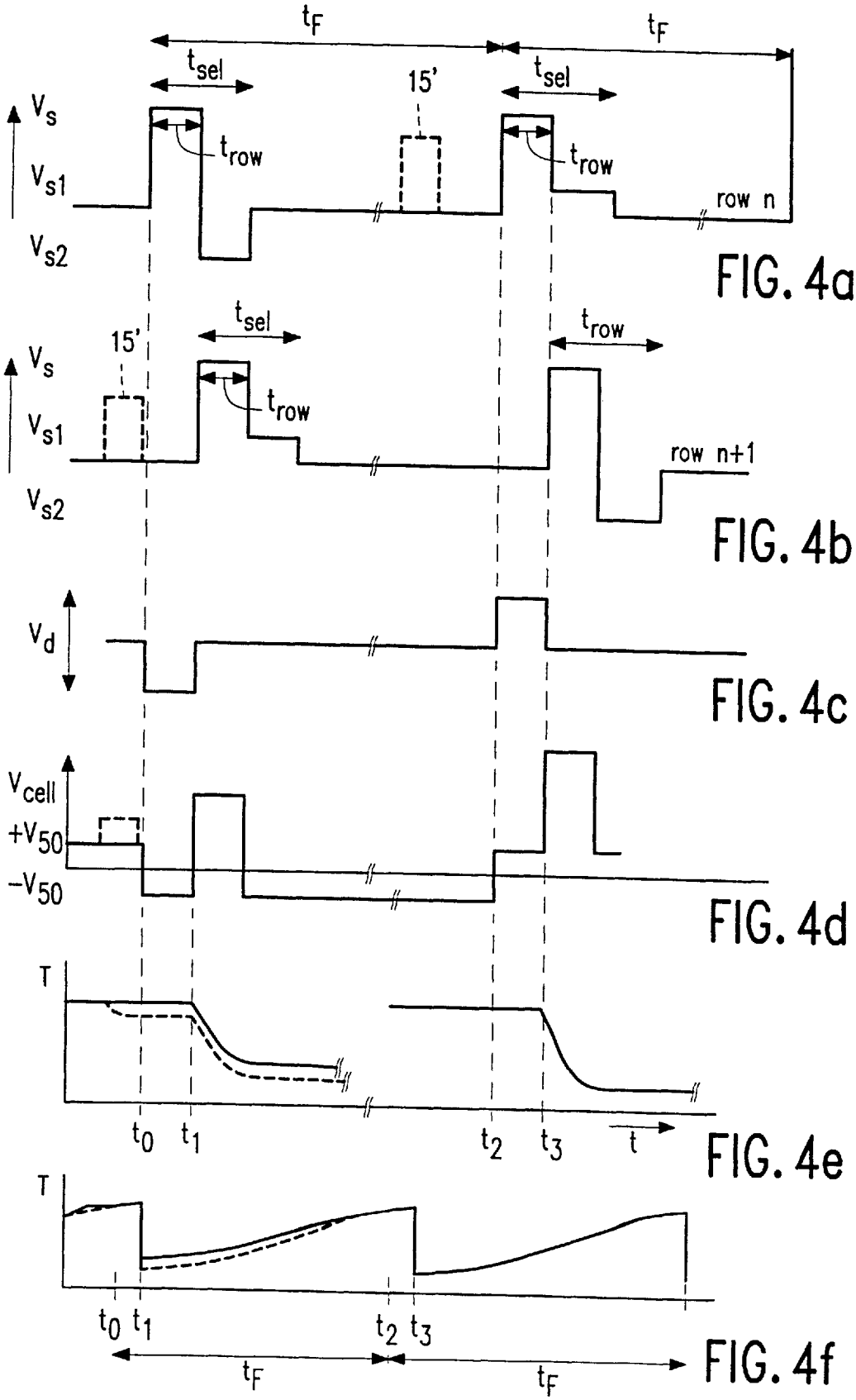
FIG. 4 and FIG. 5 show a pulse pattern of a display device in accordance with the invention.

FIG. 4 shows a number of drive signals for the device of FIG. 1. During a field period $t_f$ of the order of 20 msec (50 Hz applications), the n rows are successively selected by means of a selection signal $V_s$ during a row-selection period $t_{row}$. (FIGS. $\mathbf{4}^a$, $\mathbf{4}^b$), while data voltages are supplied to the column electrodes (shown for one column in FIG. $\mathbf{4}^c$). As mentioned hereinabove, also a gate-bias signal $V_g$ is presented (in this example after selection), and the term selection period ($t_{sel}$) is to be taken to mean the period which, for one selection of one row of pixels, comprises the selection signal and the bias signal.

To illustrate the invention, it is assumed that during selection of row n, data is presented via a column electrode corresponding to 50% transmission. In this example, for row n, a field on which negative information is written starts at the instant $t_0$. The display cell then receives a voltage $V_{cell}$ of $-V_{50}$, which corresponds, in a typical example, to −2.5 volt. At the instant $t_1$, a row (n+1) is selected. As a result of the capacitive coupling of the auxiliary capacitor with the common point of the source electrode 21 and the display element in the preceding row of pixels, the selection pulse, having a duration, for example, of 20 μsec and an amplitude of 20 volt, applies a pulse which also has a duration of 20 μsec and an amplitude of approximately 10 volt to the preceding row (FIG. $\mathbf{4}^d$). In this case, it is assumed that the capacitance value of the auxiliary capacitor is approximately equal to that of the display cell at 50% transmission. The cell (pixel) then receives a voltage $V_{cell}$ of 7.5 volt during 20 μsec, as a result of which the cell capacitance (pixel capacitance) is temporarily increased and the transmission initially reduced (FIG. $\mathbf{4}^e$). Subsequently, the cell again receives the voltage $V_{cell}$ of $-V_{50}$, so that the transmission relaxes to approximately 50% again. The total amount of time required for this may be up to tens of milliseconds. To explain this, the variation of the transmission is plotted on a different time scale in FIG. $\mathbf{4}^f$. For simplicity, the influence of the gate-bias signal is incorporated in the influence of the selection signal.

At the instant $t_2$, the subsequent field, that is the subsequent selection, begins for row n, on which field positive information is now written. The display cell then receives a voltage $V_{cell}$ of $+V_{50}$ (+2.5 volt). At the instant $t_3$, the row (n+1) is again selected. The above-mentioned capacitive coupling via the auxiliary capacitor again leads to a pulse having a duration of approximately 20 μsec and an amplitude of approximately 10 volt on the preceding row (FIG. $\mathbf{4}^d$). The cell then receives a voltage $V_{cell}$ of 12.5 volt for 20 μsec, as a result of which the transmission of the cell temporarily relaxes to a still lower value than after the instant $t_1$ (FIG. $\mathbf{4}^e$). This temporary reduction of the transmission is visible as so-called flicker, which has a frequency of 25 Hz (30 Hz in 60 Hz applications) and which is very disturbing to the viewer.

Figures 5A, 5B, 5C, 5D, 5E, 5F:
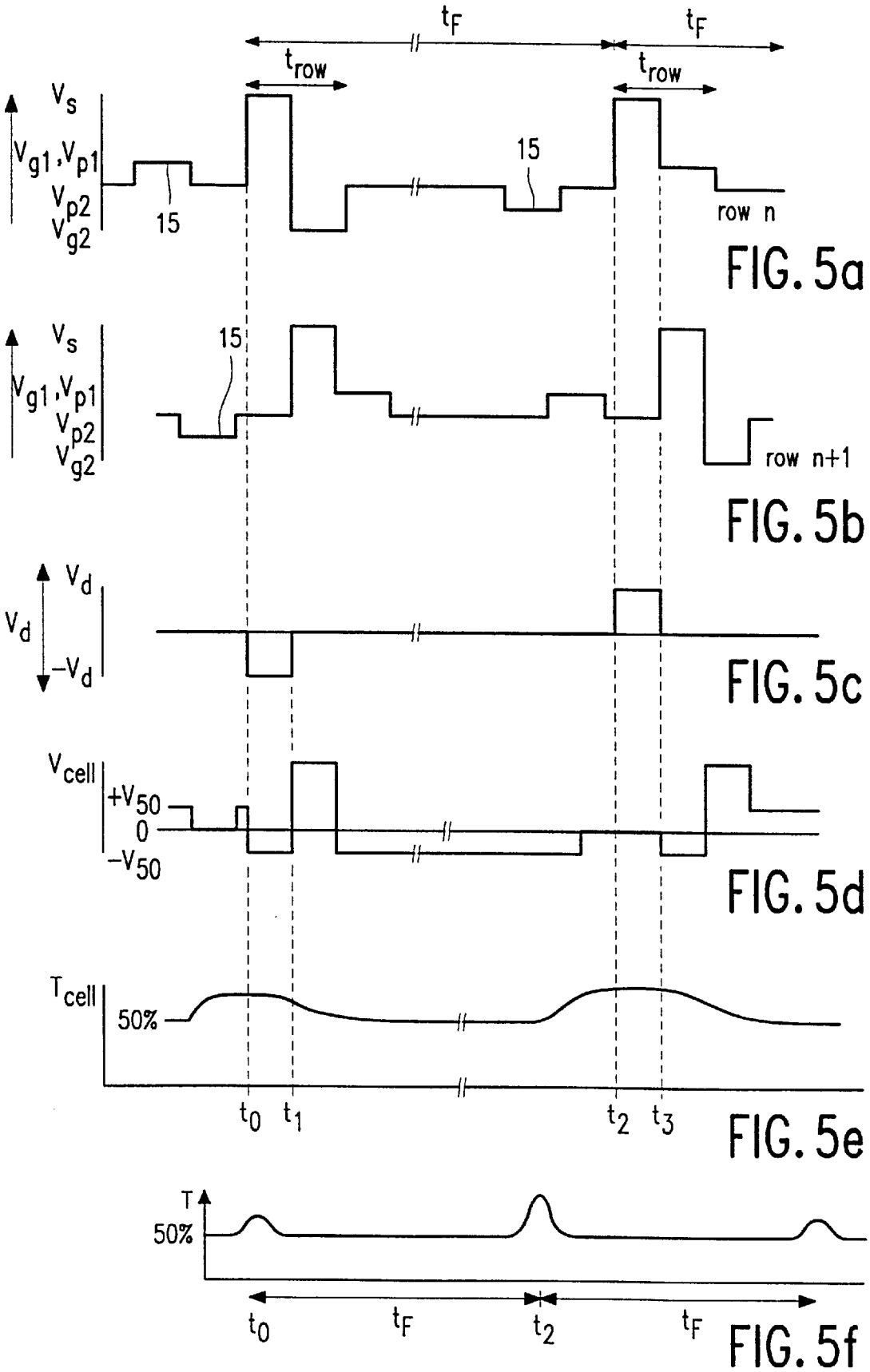

FIG. 5 shows the same drive signals, with this difference that the selection signals are now preceded by auxiliary signals 15 (FIG. $\mathbf{5}^{a,b}$). The amplitude of these auxiliary signals is sufficiently low, so that the TFTs are non-conducting (the leakage current $I_{off}$ integrated across the period of a pulse causes, for example, a voltage difference on the picture electrode of less than 10 mV) but, presumably via the same capacitive coupling that otherwise maintains the voltage across the cell at too low a level during the first field, the voltage $V_{cell}$ is slightly reduced, while in the second field the voltage $V_{cell}$ is increased, in the present example to 0 volt. As a result thereof, the transmission is temporarily increased (the absolute value $/V_{cell}/$ is reduced) in both cases. Dependent upon the duration and the amplitude of the auxiliary signals both fields then receive voltages $V_{cell}$, as shown in FIG. $\mathbf{5}^d$, and thus temporary increases in transmission (FIG. $\mathbf{5}^e$) which compensate for the reductions as described with reference to FIG. 4.

Particularly if the auxiliary signals are presented within a few row or selection periods (preferably fewer than 5 selection periods) before or after selection, it is found that these auxiliary signals practically completely compensate for the reduction in transmission shown in FIG. $\mathbf{4}^{e,f}$. FIG. $\mathbf{5}^f$ shows the transmission behavior along a continuous time axis. In this manner, the duration of the temporary change in transmission is limited to approximately 250–500 μsec, which is practically invisible. In this example, the amplitude of both auxiliary signals 15 in the different fields was approximately 5 volt and the pulse duration was 150–300 μsec. The pulse width and the pulse height may have different values for the auxiliary signals in successive field periods (selections). By a suitable choice of the distance between auxiliary signals and selection signals it is achieved that, after the pulse widths and the pulse heights of the auxiliary signals for the (still visible) transmission increases have been chosen, both fields, integrated with respect to time, are practically identical and hence invisible to the eye (FIG. $\mathbf{5}^f$).

To preclude that the auxiliary signals influence, via said capacitive coupling, the writing of data on the preceding row, these auxiliary signals are not presented jointly with the selection signals of the preceding row. As a result, in FIG. 5 the signals 15 for row (n+1) precede the instant $t_0$ or $t_2$, respectively.

A display device comprising said drive means additionally proved to be practically insensitive to temperature variations as regards the auxiliary signals to be used.

The pulse duration and amplitude of the auxiliary signals 15 in the different fields (for two successive selections of a row of pixels) may be different. In an extreme case, the auxiliary signal may be limited to one field. In FIG. 4, $t_0$ is preceded by an auxiliary signal 15' (indicated by interrupted lines) having such a large amplitude that the temporary increase of the voltage $V_{cell}$ brings about a reduction of the transmission (FIG. $4^e$) in the first field (also indicated by interrupted lines). As a result, the transmission behavior is practically identical to that in the second field. By virtue thereof, the flicker frequency has doubled to 50 (60) Hz, so that this flicker is not, or hardly, observable. FIG. $4^f$ again shows, the transmission behavior along a continuous time axis.

Although the selection signals in both examples are based on row inversion, the invention can also be applied to display devices having, for example, block inversion or frame inversion. In the example shown here, the auxiliary capacitors are situated between transistors associated with the pixels and the preceding row electrode, however, also a capacitive coupling, for example, with a subsequent row electrode is possible. In the latter case, the auxiliary signal is preferably presented after the selection.

Adaptation of the pulse width or pulse height (or both) of the auxiliary signal may also help (and, if necessary, may be slightly adjusted for this purpose) to minimize the influence of other, smaller effects, which cause flicker.

In summary, the invention relates to a display device having a TFT-matrix and auxiliary capacitors, in which before (or after) a selection signal (and, if necessary, a gate-bias signal) the gate electrode of a TFT is provided with an auxiliary signal to preclude flicker.

What is claimed is:

1. A display device comprising:

an electro-optical material sandwiched between two substrates, at least one substrate being transparent, while a first substrate is provided with a matrix of picture electrodes, each picture electrode being coupled, via a switching element, to a row electrode and a column electrode, and the picture electrode being capacitively coupled to a further electrode, first drive means for providing the row electrodes, during a selection period, with a selection signal, and the row electrode of the further electrode with a bias signal, second drive means for providing the column electrodes with a data signal which, during successive selections, changes sign relative to a reference voltage, characterized in that the drive means comprise means for presenting an auxiliary signal to the row electrodes outside the selection periods for at least one of two successive selections of the same pixel.

2. A display device as claimed in claim 1, characterized in that the second substrate comprises at least one counter-electrode.

3. A display device as claimed in claim 1, characterized in that the drive means comprise means for presenting the auxiliary signal within at most five selection periods before or after the selection period comprising the selection signal.

4. A display device as claimed in claim 1, characterized in that the drive means comprise means for presenting auxiliary signals to the row electrodes outside the selection periods for two successive selections of the same pixel, which auxiliary signals change sign relative to a second reference voltage.

5. A display device as claimed in claim 4, characterized in that during two successive selections of the same pixel, the auxiliary signals have different amplitudes.

6. A display device as claimed in claim 4, characterized in that during two successive selections of the same pixel, the auxiliary signals have different pulse widths.

7. A display device as claimed in claim 4, characterized in that the difference in time between the auxiliary signal and the selection period for successive selections is different.

8. A display device as claimed in claim 1, characterized in that the picture electrode is capacitively coupled to an adjoining row electrode.

* * * * *